US006092449A

United States Patent [19]

Ward et al.

[11] Patent Number: 6,092,449

[45] Date of Patent: Jul. 25, 2000

[54] STACKER FOR LABELS AND THE LIKE

[75] Inventors: Donald J. Ward, Sayre, Pa.; Donald A. Campbell, Binghamton, N.Y.

[73] Assignee: Paxar Corporation, White Plains, N.Y.

[21] Appl. No.: 08/918,532

[22] Filed: Aug. 22, 1997

[51] Int. Cl.[7] ..... B26D 7/32

[52] U.S. Cl. ..... 83/94; 83/155.1; 83/156

[58] Field of Search ..... 83/156, 157, 94, 83/96, 422, 436.3, 436.7, 436.15, 155; 271/273, 271, 274, 198, 212

[56] References Cited

U.S. PATENT DOCUMENTS

| | | | |
|---|---|---|---|
| 2,808,884 | 10/1957 | Shann et al. | 83/422 |
| 3,559,516 | 2/1971 | Freeman | 83/94 |
| 3,874,650 | 4/1975 | Steigerwald et al. . | |
| 4,189,965 | 2/1980 | Kollann | 83/157 |
| 4,441,390 | 4/1984 | Hechler et al. | 83/94 |
| 4,552,352 | 11/1985 | Nickels, Jr. et al. | 271/273 |
| 4,673,175 | 6/1987 | Morita | 271/271 |
| 4,943,043 | 7/1990 | Huggins et al. . | |
| 4,949,608 | 8/1990 | Ward et al. . | |
| 5,106,077 | 4/1992 | Kawaguchi et al. | 271/273 |
| 5,201,259 | 4/1993 | Covert et al. | 83/422 |
| 5,215,301 | 6/1993 | Oshino et al. . | |
| 5,265,731 | 11/1993 | Van De Ven | 271/198 |
| 5,265,868 | 11/1993 | Bowser et al. | 271/274 |
| 5,275,395 | 1/1994 | Boggiano et al. | 271/274 |
| 5,379,993 | 1/1995 | Takamura et al. | 271/273 |
| 5,421,569 | 6/1995 | Davidson | 271/274 |
| 5,431,389 | 7/1995 | Wensink et al. | 271/273 |
| 5,433,431 | 7/1995 | Lowell | 271/273 |

*Primary Examiner*—Rinaldi I. Rada
*Assistant Examiner*—Kim Ngoc Tran
*Attorney, Agent, or Firm*—Joseph J. Grass

[57] ABSTRACT

There is disclosed a stacker used in conjunction with a cutter, wherein the stacker has a roller assembly which is pivotally mounted to facilitate in servicing and for clearing jams. The stacker is positioned close to a cutter assembly to enable short labels to be received and advanced by the stacker.

13 Claims, 3 Drawing Sheets

STACKER FOR LABELS AND THE LIKE

BACKGROUND OF THE INVENTION

1. Field of the Invention

This invention relates to the field of stackers.

2. Brief Description of the Prior Art

The following U.S. patents are made-of record: U.S. Pat. No. 3,874,650 to Steigerwald et al; U.S. Pat. No. 4,943,043 to Huggins et al; U.S. Pat. No. 4,949,608 to Ward et al; and U.S. Pat. No. 5,215,301 to Oshino et al.

SUMMARY OF THE INVENTION

The invention relates to an improved stacker for labels and the like which is especially useful for relatively short labels.

It is a feature of the invention to provide an improved stacker with the capability of providing ready access to a conveyor which transports labels from a cutter to a stacking unit. According to a specific embodiment of the invention, a roller assembly is positioned above the conveyor to hold the labels against the conveyor, but the roller assembly is movable to an open position away from the conveyor to facilitate clearing of misfed labels and the like. It is preferred that the roller assembly is pivotal with respect to the conveyor. It is also preferred to have a conveyor with a driven infeed roller and for the roller assembly to have an infeed idler roller cooperating with the driven infeed roller and that other rollers of the roller assembly be floatingly mounted so that they roll on the advancing conveyor. The roller-to-roller spacing of the rollers in the roller assembly is close enough that the shortest label establishes contact with the next roller along the path of label travel before contact with the immediately preceding roller is lost. The infeed rollers are preferably of relatively small diameters so that the conveyor can be positioned close to a cutter which cuts the labels from a web. It is also preferred to provide for easy removal of the driven infeed roller and an adjacent grooved roller without disassembling the entire stacker.

DETAILED DESCRIPTION OF A PREFERRED EMBODIMENT

Figure 1:
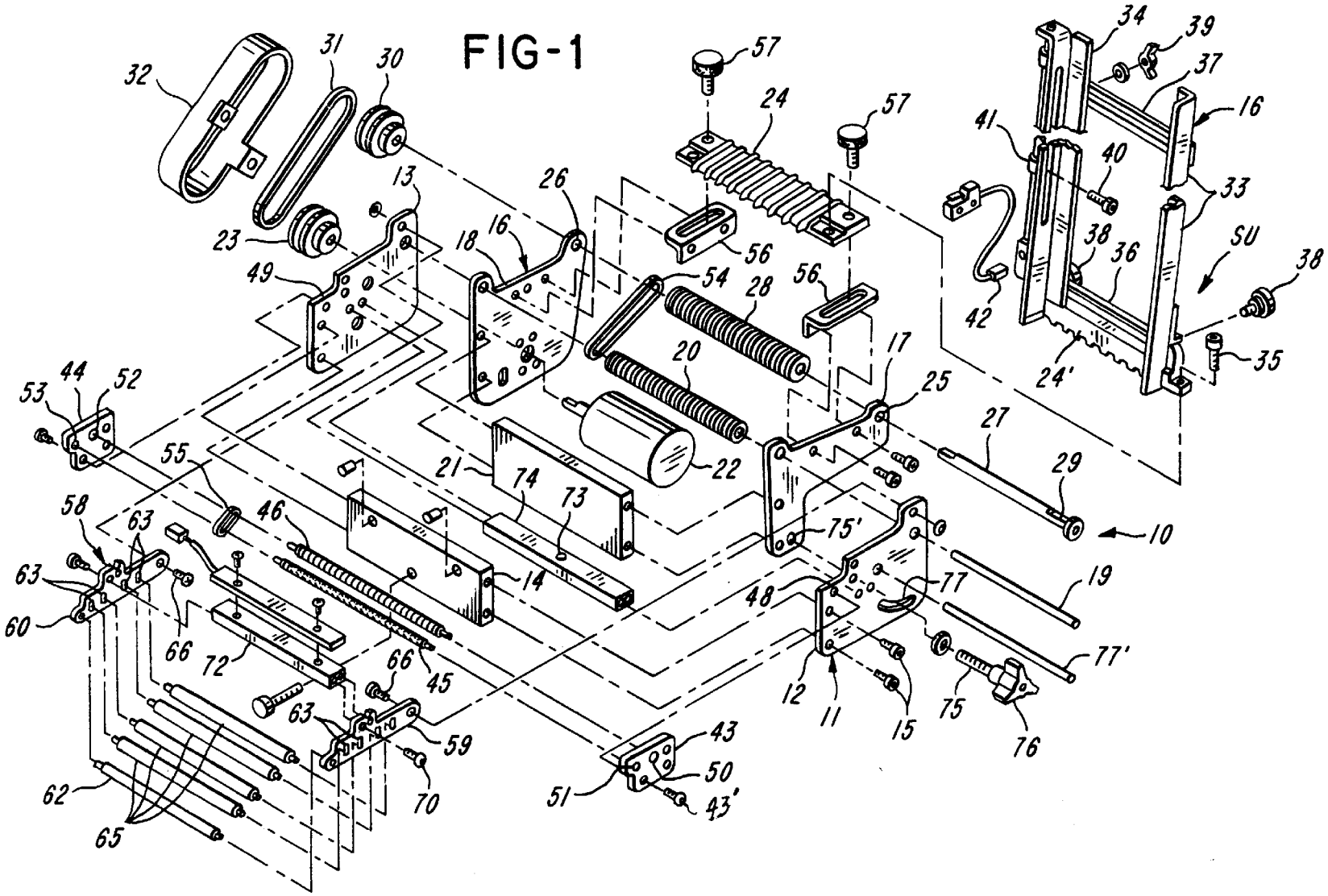
FIG. 1 is an exploded perspective view of a stacker in accordance with the invention.

With reference to FIG. 1, there is shown a stacker generally indicated at 10. The stacker 10 includes a frame generally indicated at 11 having a pair of laterally spaced frame plates 12 and 13 connected by a beam 14 through various screws 15 (some of which are shown). An adjustable subframe generally indicated at 16 is mounted on the frame 11. The subframe 16 includes laterally spaced plates 17 and 18. A rod or shaft 19 passes through the frame plate 12, through the plate 17, through a grooved roller 20, through the plate 18 and is threadably received in the frame plate 13. The plates 17 and 18 are rigidly secured to a beam or plate 21. The frame 16 can pivot about the shaft 19. An electric motor 22 is mounted on the plate and drives a pulley wheel 23. The plates 17 and 18 mount a grooved plate 24. The plates 17 and 18 have respective holes 25 and 26 which rotatably mount a shaft 27. A grooved roller 28 is secured to the shaft 27 by a set screw (not shown) which bears against a flat 29. A pulley wheel 30 is secured to the shaft 27. A pulley belt 31 is trained about pulley wheels 23 and 30. A housing 32 for the pulley wheels 23 and 30 and the pulley belt 31 is secured to the outside of the plate 13.

A pair of angle-shaped uprights 33 and 34 are secured to the grooved plate 24 by screws 35 (only one of which is shown). The uprights 33 and 34 are adjustably connected by bars 36 and 37 to accommodate labels of different widths and are held in adjusted positions by screws 38 and a wing nut 39. The topmost label in the stack contacts a screw 40 threadably secured to a block 41 which controls a sensor 42 when the stack is full to disable the motor 22.

A pair of bearing blocks 43 and 44 rotatably mount a driven infeed roller 45 and a driven grooved roller 46. As shown, the side plates 12 and 13 have cutouts 48 and 49. Holes 50 and 52 in the bearing blocks 43 and 44 mount the grooved roller 46 and holes 51 and 53 in the bearing blocks 43 and 41 mount the driven infeed roller 45. The holes 50 and 51 extend beyond the side plate 12 and the holes 52 and 53 extend beyond the side plate 13. Screws 43' removably hold the bearing blocks 43 and 44 to the respective side-plates 12 and 13. It is apparent that the rollers 45 and 46 can be readily serviced by removing the screws 43' without disassembling any substantial portion of the machine 10. A series of side-by-side belts 54 only some of which are shown for clarity, are trained about the rollers 20, 28, and 45 and the grooved plate 24. Normally the bottom of the stack is supported by the belts 54, the plate 24 and the roller 20. The roller 28 is shown to be at a lower level than the roller 20. As the belts 54 pass over the roller 20 they extend downwardly and rearwardly as they approach the roller 28. This causes a V-shaped opening to exist between the bottom of front the stack of labels L and the belts 54. This V-shaped opening enables the next label L to enter the bottom of the stack without stumbling on the stack.

Figure 2:
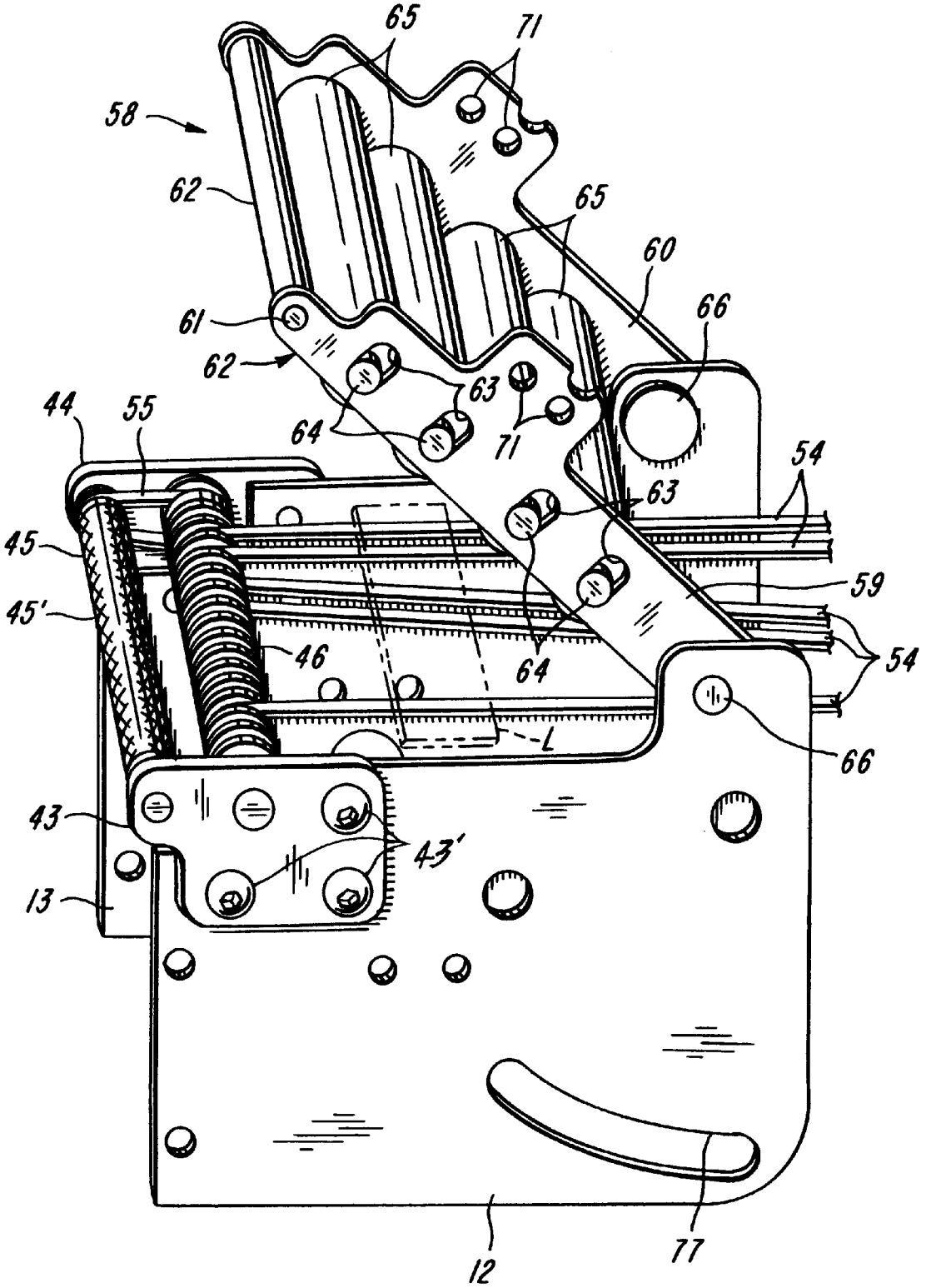
FIG. 2 is an assembled perspective view of the roller assembly and a portion of the conveyor.
Figure 3:
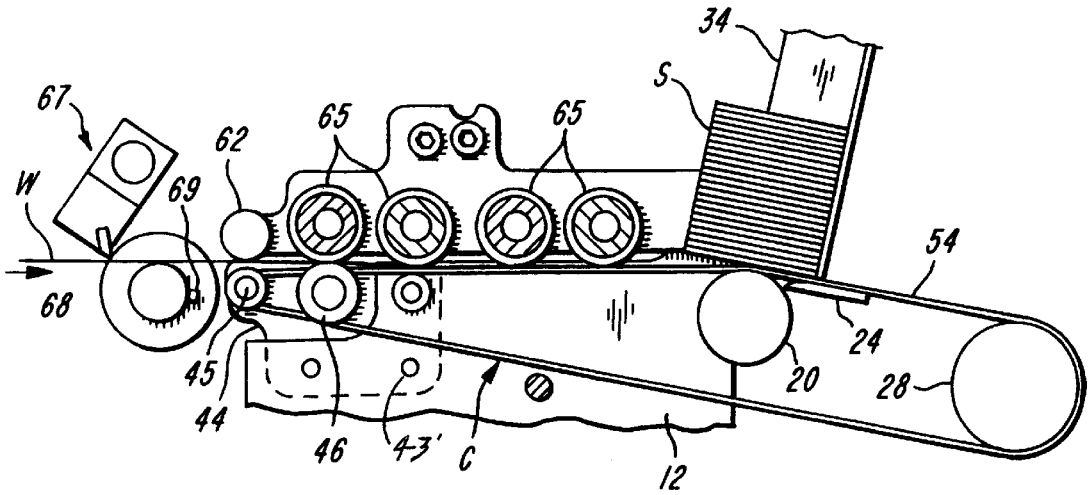
FIG. 3 is a sectional view through a portion of the stacker in relation to a cutter.

During the use of the stacker 10, labels L are supported on the upper pass of the belts 54 as shown in FIG. 3. As best shown in FIG. 2, a drive connection is provided by an endless belt 55 that drives the infeed roller 45. The infeed roller 45 rotates in the same direction as the roller 46. Although the diameter of the roller 45 is less than that of the roller 46, both rollers 45 and 46 have the same peripheral speed. The roll 45 preferably has a knurled surface 45' as shown, but it can alternatively have an elastomeric outer sleeve (not shown).

Adjusting plates 56 are secured to the plates 17 and 18. The position of the plate 24 is adjustably secured to the plates 56 by screws 57.

With reference to FIGS. 1 and 2, a roller assembly generally indicated at 58 includes a pair of plates or holder members 59 and 60 connected by a shaft 61 which mounts an infeed idler roller 62. The plates 59 and 60, the connecting shaft 61 and bars 72 and 74 constitutes a subframe 78. The plates 59 and 60 have vertically extending aligned pairs of elongate slots 63. Shafts 64 on rollers 65 extend into the slots 63. The plates 59 and 60 are pivoted on pivots 66 to the plates 12 and 13. The idler roller 62 bears gravitationally against the driven roller 45, the adjacent idler roller 65 bears against the grooved roller 46, and the other three idler rollers 65 bear against the upper pass of the endless belts 54. The slots 63 enable the rollers 65 to press downwardly under their own weight, that is, float independently of the weight of the remainder of the roller assembly 58. The roller 62 is non-floatingly mounted and the weight of the roller assembly 58 which is not supported by pivots 66 bears down on the drive roller 45. Thus, feeding cooperation of the rollers 45 and 62 with an incoming label L is established. This distance between the nip or tangent point of rollers 45 and 62 and the nip or tangent point of the adjacent roller pair 46 and 65 is less than the length of the shortest label L. Likewise, the distance between tangent point of each adjacent pair of rollers 65 and the belts 54 is less than the length of the shortest label L. The rollers 62 and 65 are disposed close enough to each other to urge the labels L against the conveyor C throughout their travel on the conveyor C and until the labels L have entered the stacking unit SU. In this way control of the transport of the labels L is maintained at all times from the cutter 67 into the stacking unit SU. For example, not limitation, in the event the shortest label is five-eights of an inch in length, the center-to-center spacing of the rollers 65 is about 0.5 inch, except the center-to-center spacing of the two inner rollers 65 is about 0.59 inch; and the center-to-center spacing of the roller 62 and the adjacent roller 65 is less than 0.5 inch.

To clear a jam, or to clean the belts 54 or the rollers 45, 46 and 65, or to service the stacker 10, the roller assembly 58 can be manually pivoted as shown in FIG. 2 to an open position, and thereafter the roller assembly 58 can be returned to its operating position shown in FIG. 3.

As shown in FIG. 3, a cutter generally indicated at 67 includes a stationary cutter blade 68 and a selectively operable rotatable cutter blade 69 cooperable with the blade 68. When it is desired to cut a label web W the blade 69 is rotated into cooperation with the blade 68. The cutter 67 is close to the infeed rollers 45 and 62 so that even short labels can be accommodated by the stacker 10. The label to be cut is received in the nip of the rollers 45 and 62 before the cut is made so that control of the label L is maintained. The belts 54 and the rollers 20, 28, 45 and 46 constitute the conveyor generally indicated at C and the uprights 33 and 34 and the plate 24 and a comb 24' constitute a stacker unit SU. The conveyor C and the stacker unit SU comprise the stacker 10. The mounting bar 72 is secured to the plates 59 and 60 by screws 70 received in holes 71. The bar 72 carries a source of light. A sensor 73 mounted on the bar 74 detects the passage of a label L over the belt 54 to provide a count of the number of labels L passing over the conveyor belts 54.

The inclination of the stacker unit SU is adjustable. When the stacker unit SU is in its adjusted position, a screw 75 received in a threaded hole 75' having a knob 76 is tightened. The screw 75 passes through a slot 77 and threads into the plate 17 to hold the stacker unit SU in its adjusted position. A belt tensioning shaft is indicated at 77'.

Other embodiments and modifications of the invention will suggest themselves to those skilled in the art, and all such of these as come within the spirit of this invention are included within its scope as best defined by the appended claims.

We claim:

1. In combination, a cutter for cutting labels from a web and a stacker adjacent the cutter, the stacker including a stacking unit and a conveyor for conveying cut labels to the stacking unit, the conveyor including a driven infeed roller, a roller assembly disposed above the conveyor, the roller assembly including a subframe and an infeed idler roller rotatably mounted on the subframe and cooperating with an incoming label to urge the label against the driven infeed roller, the roller assembly further including a plurality of floatingly mounted other idler rollers mounted on the subframe and supported by the conveyor, wherein the other floatingly mounted idler rollers are independently mounted relative to each other and relative to the subframe, and the roller assembly being movable between an operating position and an open position wherein the idler rollers are out of contact with the conveyor.

2. A stacker for stacking labels, comprising: a stacking unit, a conveyor for conveying cut labels to the stacking unit, the conveyor including a driven infeed roller, a roller assembly disposed above the conveyor, the roller assembly including a subframe and an infeed idler roller rotatably mounted on the subframe and cooperating with an incoming label to urge the label against the driven infeed roller, the roller assembly further including a plurality of floatingly mounted other idler rollers mounted on the subframe and supported by conveyor, wherein the floatingly mounted other idler rollers are independently mounted relative to each other and relative to the subframe, and the roller assembly being movable between an operating position and an open position wherein the idler rollers are out of contact with the conveyor.

3. a stacker for stacking labels, comprising: a conveyor having a frame and a stacking unit for receiving labels from the conveyor, the conveyor having a driven infeed roller and a grooved roller, conveyor belts tracking in the grooved roller, a drive connection between the driven infeed roller and the grooved roller, at least one removable bearing block for the driven infeed roller and the grooved roller, the bearing block or blocks being removably connected to the frame to facilitate servicing of the grooved roller, the driven infeed roller, the drive connection and the conveyor belts.

4. A stacker as defined in claim 3, wherein the drive connection includes an endless belt.

5. A stacker as defined in claim 4, wherein the driven infeed roller and the grooved roller rotate in the same direction.

6. A stacker for stacking labels, comprising: a frame, a stacking unit mounted to the frame, a conveyor mounted to the frame for conveying labels to the stacking unit, a roller assembly mounted above the conveyor, the roller assembly having a subframe and a plurality of floating idler rollers rotatably mounted to and with respect to the subframe, the subframe being movably mounted to the frame for movement between an operating position wherein the rollers contact the labels to hold the labels against the conveyor and an open position wherein the rollers are spaced from the conveyor for access to the labels on the conveyor and/or the conveyor, and wherein the plurality of rollers are disposed close enough to each other to urge the labels against the conveyor throughout their travel on the conveyor and until the labels enter the stacking unit.

7. A stacker for stacking labels, comprising: a frame, a stacking unit mounted to the frame, a conveyor mounted to the frame for conveying labels to a stacking unit, a roller assembly mounted above the conveyor, the roller assembly having a subframe and a plurality of rollers rotatably mounted to the subframe, the subframe being movably mounted to the frame for movement between an operating position wherein the rollers contact the labels and hold the labels against the conveyor and an open position wherein the rollers are spaced from the conveyor for access to the labels on the conveyor and/or the conveyor, and wherein the subframe is comprised of spaced, connected holder members having aligned pairs of elongate slots for mounting the rollers.

8. A stacker for stacking labels, comprising: a frame, a stacking unit mounted to the frame, a conveyor mounted to the frame for conveying labels to a stacking unit, a roller assembly mounted above the conveyor, the roller assembly having a subframe and a plurality of rollers rotatably mounted to the subframe, the subframe being movably mounted to the frame for movement between the operating position wherein the rollers contact the labels and hold the labels against the conveyor and an open position wherein the rollers are spaced from the conveyor for access to the labels on the conveyor and/or the conveyor, wherein the conveyor includes a driven infeed roller, wherein the roller assembly has an infeed idler roller which cooperates with the driven infeed roller, and wherein the plurality of rollers comprise other idler rollers which float with respect to each other and with respect to the subframe and cooperate with the conveyor.

9. A stacker as defined in claim 8, wherein the infeed idler roller is non-floatingly mounted by the subframe.

10. A stacker for stacking labels, comprising: a frame, a stacking unit mounted to the frame, a conveyor mounted to the frame for conveying labels to a stacking unit, a roller assembly mounted above the conveyor, the roller assembly having a subframe and a plurality of rollers rotatably mounted to the subframe, the subframe being movably mounted to the frame for movement between an operating position wherein the rollers contact the labels and hold the labels against the conveyor and an open position wherein the rollers are spaced from the conveyor for access to the labels on the conveyor and/or the conveyor, wherein the conveyor includes a driven infeed roller and a belt conveyor unit, wherein the belt conveyor unit includes a plurality of grooved rollers, wherein laterally spaced belts track in grooves in the grooved rollers, wherein one of the grooved rollers is adjacent the driven infeed roller, and wherein the driven infeed roller has a smaller diameter than the adjacent grooved roller.

11. A stacker as defined in claim 10, and a belt drivingly connecting the infeed roller and the adjacent grooved roller.

12. A stacker as defined in claim 10, including at least one removable bearing block for the driven infeed rollers and the grooved roller to provide access to the driven infeed roller and the driven grooved roller.

13. In combination: a cutter for cutting labels from a web and a stacker adjacent the cutter, the stacker including a stacking unit and a conveyor for conveying cut labels to the stacking unit, the conveyor including a driven infeed roller, a roller assembly disposed above the conveyor, the roller assembly including a subframe and an infeed idler roller rotatably mounted on the subframe and cooperating with an incoming label to urge the label against the driven infeed roller, the roller assembly further including a plurality of floatingly mounted idler rollers mounted on the subframe and supported by conveyor, wherein the idler rollers are independently floatingly mounted relative to each other and with respect to the subframe, the roller assembly being movable between an operating position and an open position wherein the idler rollers are out of contact with the conveyor, and wherein the plurality of idler rollers are disposed close enough to each other to urge the labels against the conveyor throughout their travel on the conveyor and until the labels enter the stacking unit.

* * * * *

UNITED STATES PATENT AND TRADEMARK OFFICE

CERTIFICATE OF CORRECTION

PATENT NO. : 6,092,449

DATED : July 25, 2000

INVENTOR(S) : Donald J. Ward and Donald A. Campbell

It is certified that error appears in the above-indentified patent and that said Letters Patent is hereby corrected as shown below:

Column 4, claim 3, line 1, "a" (first occurrence) should be --A--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*